US007216874B2

(12) United States Patent
Lin

(10) Patent No.: US 7,216,874 B2
(45) Date of Patent: May 15, 2007

(54) INLINE SKATE WITH AN ADJUSTABLE LENGTH

(76) Inventor: Henkel Lin, No. 13, Lane 130, Kung-An Rd., Houli Hsiang, Taichung Hsien (TW)

( * ) Notice: Subject to any disclaimer, the term of this patent is extended or adjusted under 35 U.S.C. 154(b) by 0 days.

(21) Appl. No.: 11/207,100

(22) Filed: Aug. 18, 2005

(65) Prior Publication Data

US 2007/0040342 A1 Feb. 22, 2007

(51) Int. Cl.
*A63C 1/26* (2006.01)

(52) U.S. Cl. ..... 280/11.26; 36/97

(58) Field of Classification Search ..... 280/11.19, 280/11.16, 11.26, 11.3, 842, 617; 36/97
See application file for complete search history.

(56) References Cited

U.S. PATENT DOCUMENTS 313,622 A * 3/1885 Raymond ..... 280/11.26
3,309,098 A * 3/1967 Parker ..... 280/11.26
3,635,854 A * 1/1972 Martin ..... 280/11.26
4,708,352 A * 11/1987 Vullierme ..... 280/11.26
5,484,149 A * 1/1996 Lee ..... 280/11.26
6,334,621 B1 * 1/2002 Chang ..... 280/11.3
6,574,888 B2 * 6/2003 Miller et al. ..... 36/97
6,742,286 B2 * 6/2004 Giovale ..... 36/7.6
6,916,027 B2 * 7/2005 Chen ..... 280/11.26
6,918,602 B2 * 7/2005 Lu ..... 280/11.26

FOREIGN PATENT DOCUMENTS

WO 2005/072832 * 8/2005

* cited by examiner

*Primary Examiner*—Frank Vanaman
(74) *Attorney, Agent, or Firm*—Alan Kamrath; Kamrath & Associates PA

(57) ABSTRACT

An inline skate with changeable length has an inner boot, an adjusting device, an outer boot and a wheel assembly. The adjusting device is attached to the inner boot and comprises a block and a key. The block has a longitudinal adjustment slot and a transverse slot communicating with the longitudinal adjustment slot. The key is mounted through the transverse slot and selectively extends into the longitudinal adjustment slot. The outer boot has an outer toe and an outer heel. The outer toe has a rear edge and a tongue formed on and protruding from the rear edge, mounted slidably in the longitudinal adjustment slot and having multiple adjustment slots. The adjustment slots selectively align with the transverse slot in the block and are engaged by the key. A wheel assembly is mounted under the outer heel. Hence, adjusting the length of the inline skate is easy and convenient.

4 Claims, 5 Drawing Sheets

INLINE SKATE WITH AN ADJUSTABLE LENGTH

BACKGROUND OF THE INVENTION

1. Field of the Invention

The present invention relates to an inline skate and, more particularly, to an inline skate with a length that can be adjusted.

2. Description of Related Art

An inline skate with multiple wheels in a row is very popular with young people, because use of the inline skate is not limited by seasons and site conditions. A conventional inline skate is comprised of an integral boot and an inside lining with a soft material to make a user's feet comfortable. However, the length of the boot is fixed such that the skate is not sensible for young users with quickly developing feet. Additionally, when a user skates with the conventional inline skate that is too large, controlling the inline skate is difficult and readily results in sports injuries.

Therefore, the invention provides an inline skate with and adjustable length to mitigate or obviate the aforementioned problems.

SUMMARY OF THE INVENTION

The main objective of the present invention is to provide an inline skate with an adjustable length to accommodate growth of a user's feet.

Other objectives, advantages and novel features of the invention will become more apparent from the following detailed description when taken in conjunction with the accompanying drawings.

DETAILED DESCRIPTION OF THE PREFERRED EMBODIMENT

Figure 1:
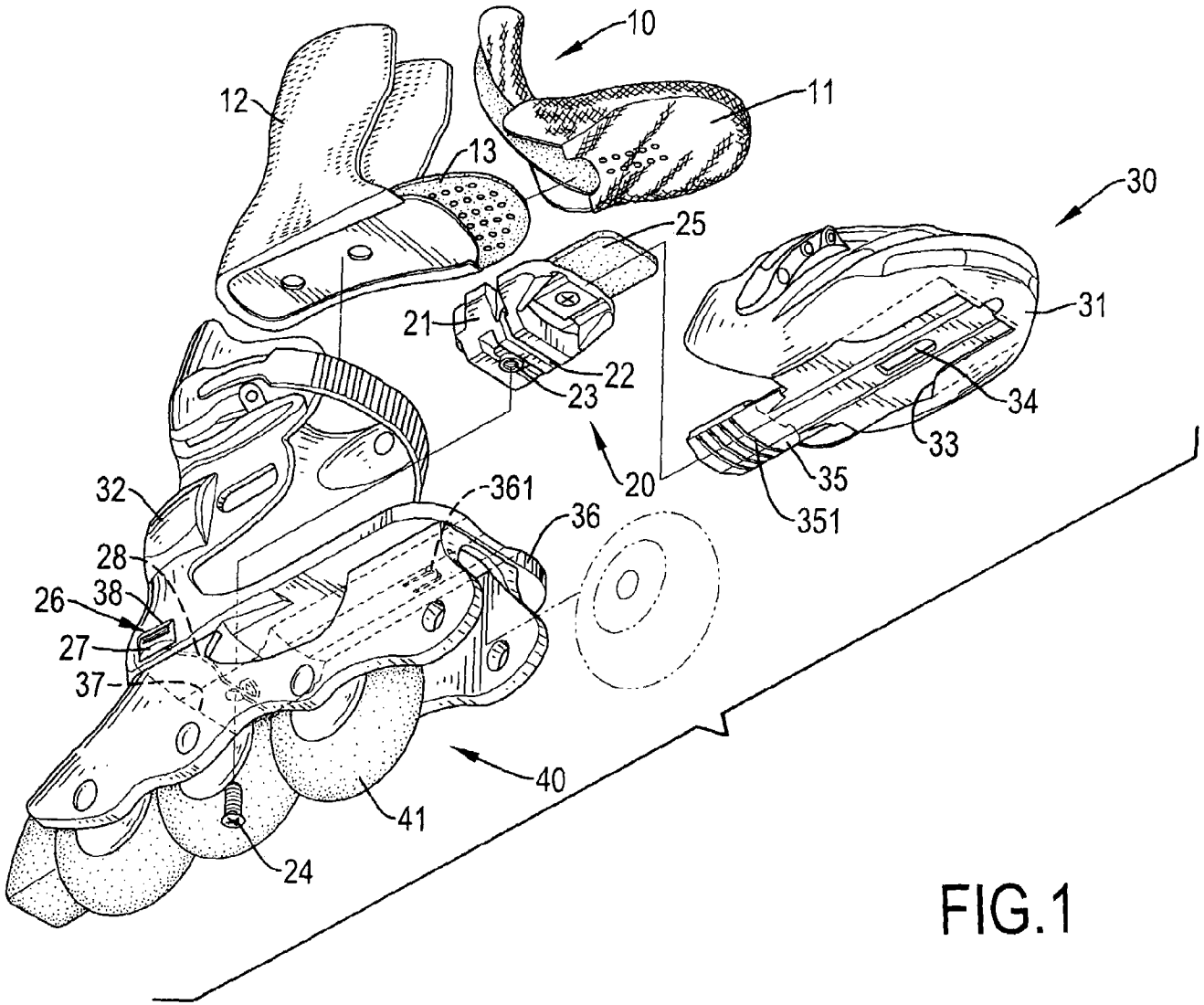
FIG. 1 is an exploded perspective view of an inline skate with an adjustable length in accordance with the present invention.
Figure 2:
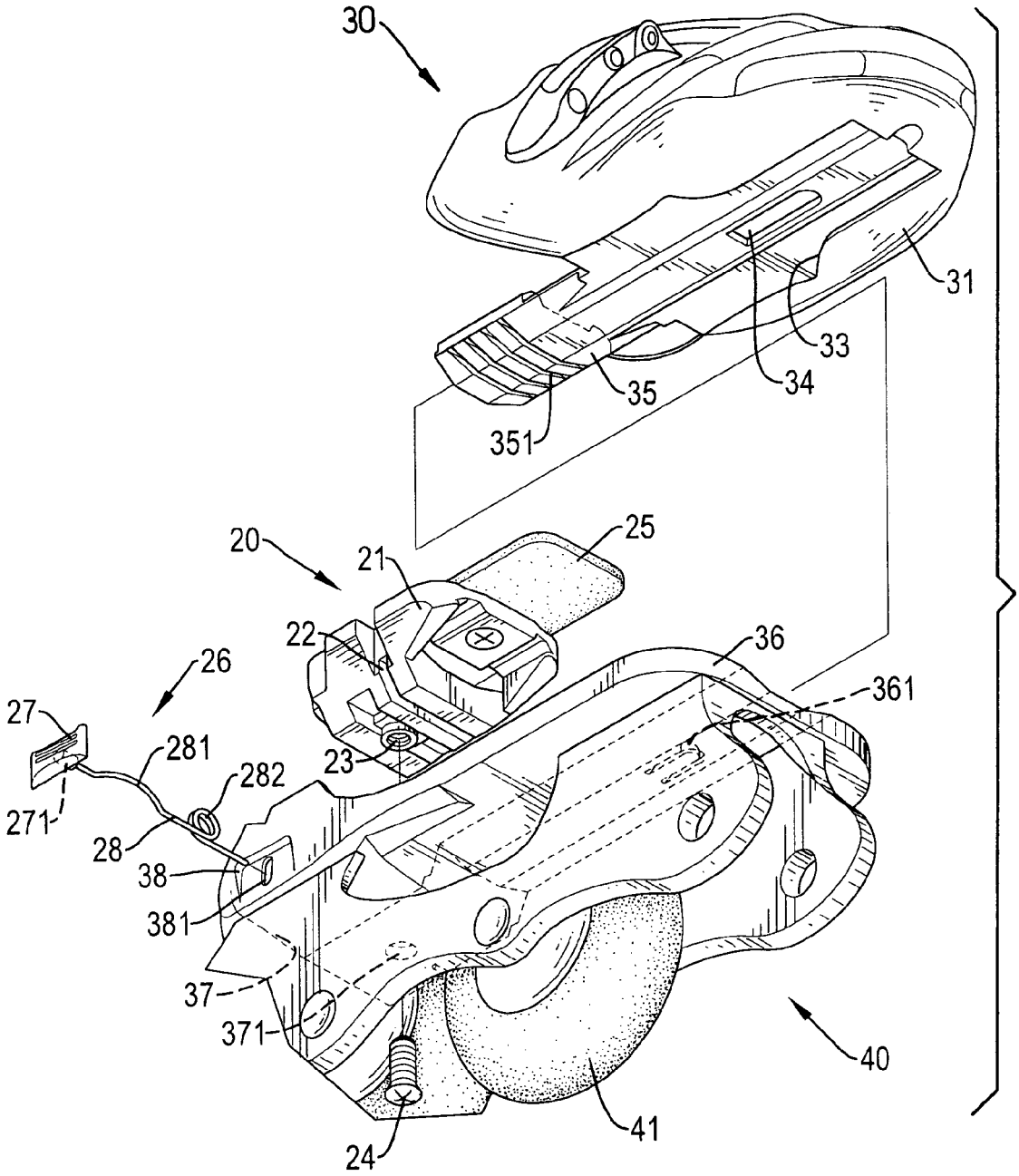
FIG. 2 is an enlarged exploded perspective view of a toe section of the inline skate in FIG. 1.

With reference to FIGS. 1–2, an inline skate with an adjustable length comprises an inner boot (10), an adjusting device (20), an outer boot (30) and a wheel assembly (40).

The inner boot (10) is composed of an inner toe (11), an inner heel (12) and an optional insole (13). The inner heel (12) is slidably holding the inner toe (11) and has a sole and a shank (25). The shank (25) is connected to the sole and has a through hole. The insole (13) is mounted inside the inner heel (12) and the inner toe (11).

The adjusting device (20) comprises a block (21) and a key (26).

The block (21) is attached to the shank (25) of the inner heel (12) and has a bottom, a front end, two sides, a longitudinal adjustment hole, a transverse slot (22), a mounting hole (23), a through hole, a boot fastener (24) and a shank fastener. The longitudinal adjustment hole is formed in the block (21) and extends to the front end. The transverse slot (22) is defined in the bottom of the block (21), extends to the two sides and communicates with the longitudinal adjustment hole. The mounting hole (23) is formed vertically through the block (21) next to the transverse slot (22) and may be threaded. The through hole is formed vertically through the block (21) near the front end. The boot fastener (24) is held in the mounting hole (23) and may be a threaded bolt. The shank fastener is mounted through the through hole in the block (22) and the through hole in the shank (25) to attach the block (22) securely to the sole of the inner heel (12) and may be a rivet.

The key (26) is mounted through the transverse slot (22) in the block (21), selectively extends into the longitudinal adjustment hole in the block (21) and has a flexible shaft (28) and a head (27). The flexible shaft (28) is mounted through the transverse slot (22) in the block (21) and has a stationary end, a moveable end, a locking segment (281) and a mounting coil (282). The locking segment (281) is formed between the ends, is mounted through the transverse slot (22) in the block (21) and selectively extends into the longitudinal adjustment hole in the block (21). The mounting coil (282) is formed in the flexible shaft (28) near the stationary end. The head (27) is attached to the moveable end of the flexible shaft (28) and has an inside surface and a lug (271). The lug (271) is defined on the inside surface of the head (27) and is mounted around the moveable end of the flexible shaft (28).

The outer boot (30) comprises an outer toe (31) and an outer heel (32).

The outer toe (31) holds the inner toe (11), is mounted adjustably in the longitudinal adjustment hole in the block (21) and has a bottom, two sides, a rear edge, two optional sliding rails (33), an elongated hole (34) and a tongue (35). The sliding rails (33) are mounted in the bottom of the outer toe (31) respectively near the sides. The elongated hole (34) is defined longitudinally in the bottom of the outer toe (31) between the sliding rails (33). The tongue (35) is formed on and protrudes from the rear edge of the outer toe (31), is mounted slidable in the longitudinal adjustment hole in the block (21) and has a bottom surface and multiple adjustment slots (351). The adjustment slots (351) are formed transversely in the bottom of the tongue (35) and selectively align with the transverse slot (22) in the block (21). The adjustment slot (351) aligned with the transverse slot (22) in the block (21) is engaged by the locking segment (281) of the key (26) to hold the outer toe (31) in position.

Figure 3:
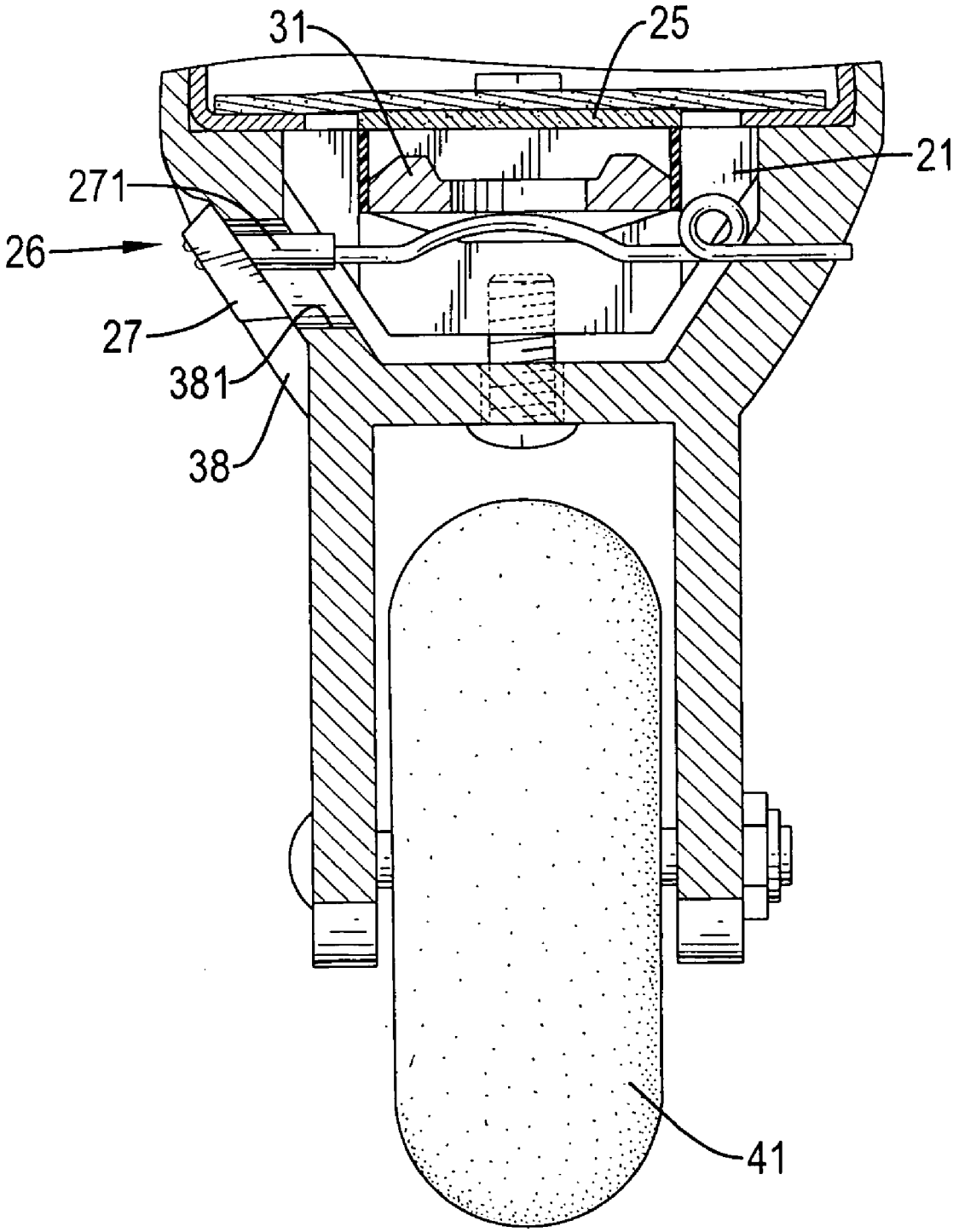
FIG. 3 is an enlarged front view in partial section of an adjusting device of the inline skate in FIG. 1 that is attached to a boot.
Figure 4:
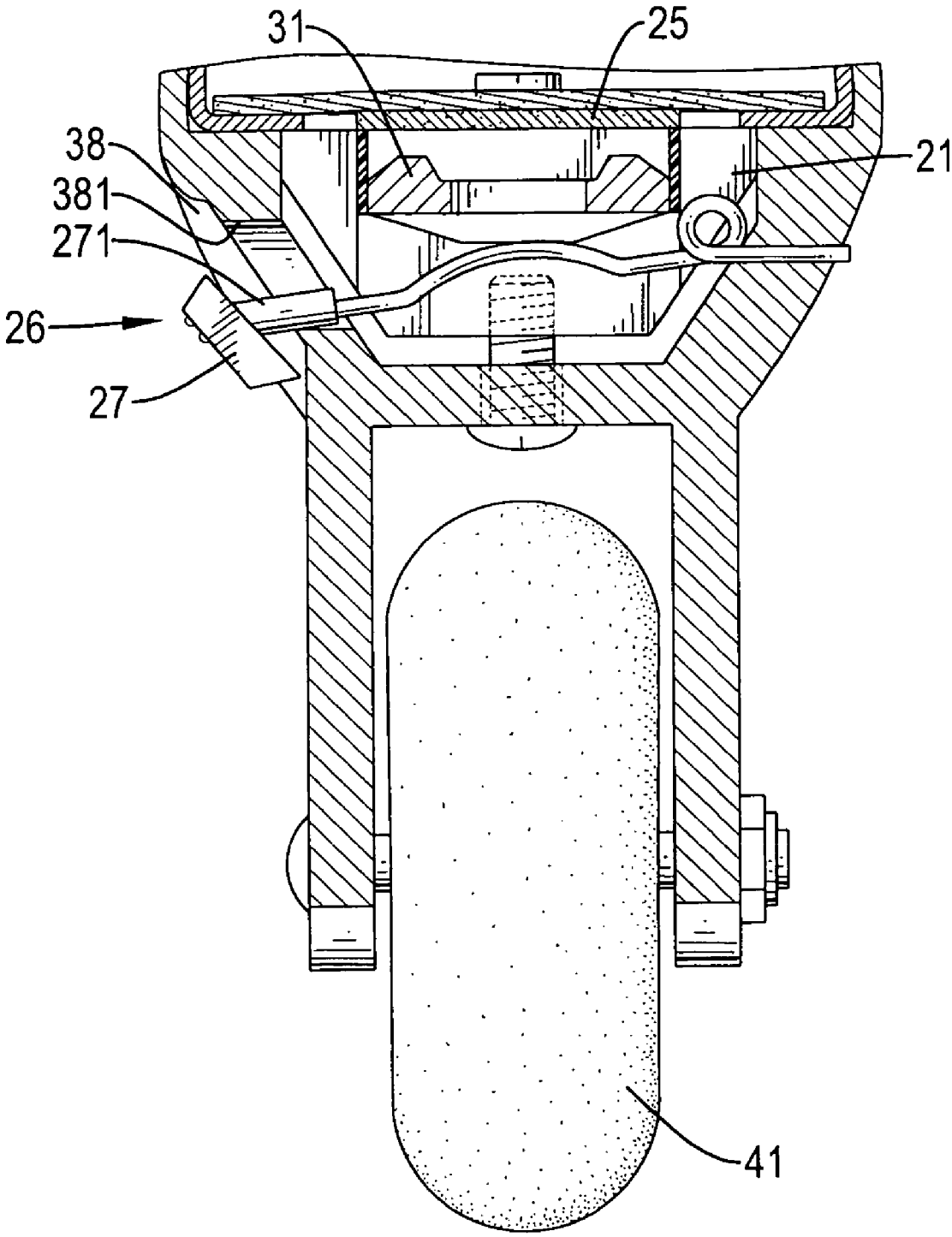
FIG. 4 is an enlarged front view in partial section of the adjusting device in FIG. 3 being separated from the boot.
Figure 5:
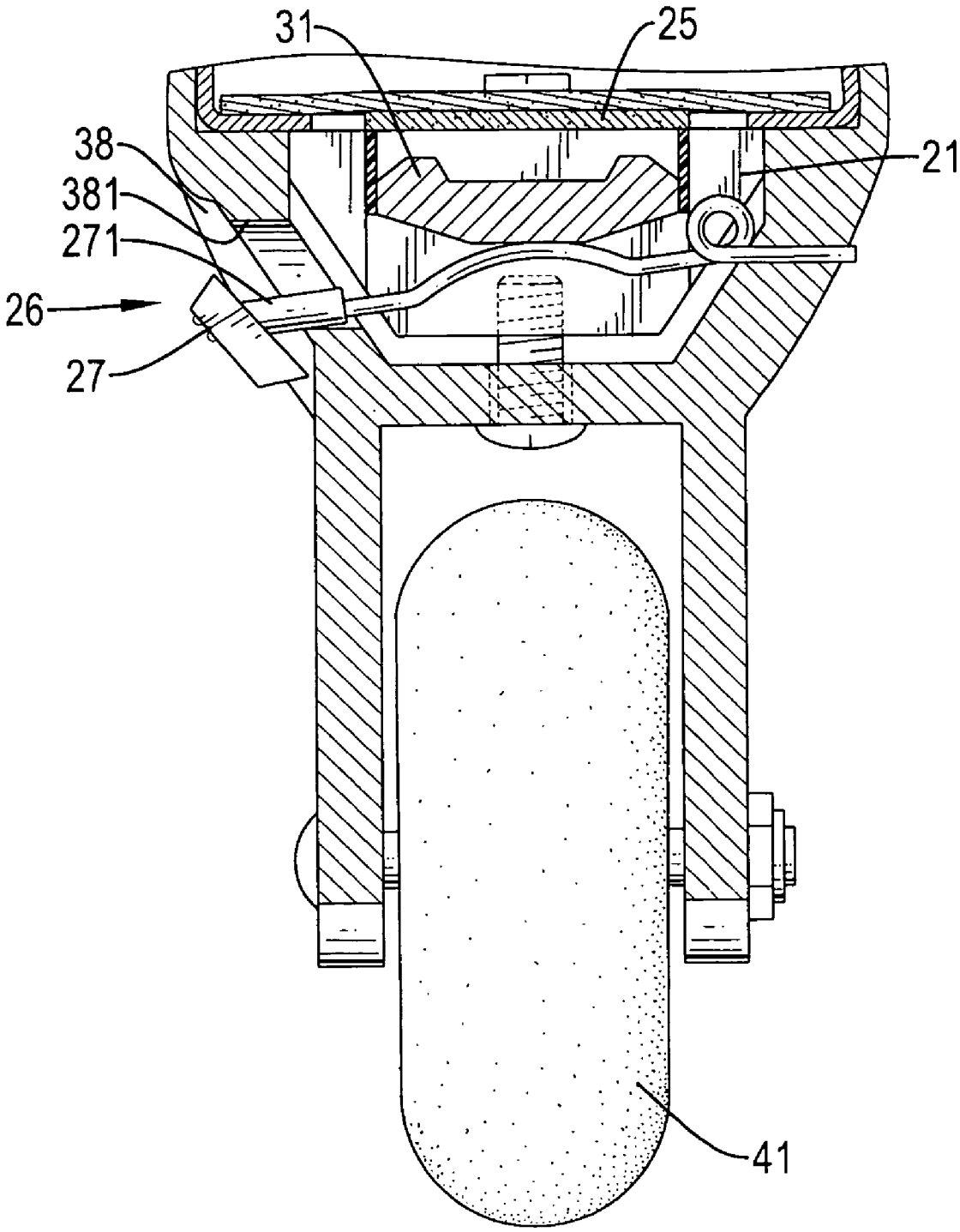
FIG. 5 is an enlarged front view in partial section of the adjusting device in FIG. 4 in position to adjust the inline skate relative to the boot.

The outer heel (32) holds the inner heel (12), is attached to the block (21) and has a front end, a rear end, two sides, a bottom, a joint (36), a chamber (37) and a notch (38). The joint (36) is formed at the front end of the outer heel (32), is slidably connected to the outer toe (31), may be mounted slidably between the sliding rails (33) in the outer toe (31) and has a protrusion (361). The protrusion (361) is formed on the joint (36) and is mounted slidably in the elongated hole (34) in the outer toe (31). The chamber (37) is defined at the rear end of the outer heel (32) to accommodate the tongue (35) and mount the adjusting device (20) and has a top end and an orifice (371). The orifice (371) is defined in the top end of the chamber (37) to allow the boot fastener (24) to be inserted into the mounting hole (23) in the block (21) of the adjusting device (20). The notch (38) is defined in a side of the outer heel (32), is aligned with the chamber (37) and the block (21) of the adjusting device (20), selectively holds the head (27) of the key (26) and has an elongated through hole (381). The elongated through hole (381) is defined in the notch (38) to allow the mounting coil (282) to pass through the side of the outer heel (32) so the stationary end of the key (26) can be mounted in the opposite side and to hold and guide the lug (271). With further reference to FIGS. 3–5, the elongated through hole (381) allows the lug (271) to be moved down so the locking segment (281) of the key (26) can be disengaged from the adjustment slot (351) in the tongue (35) of the outer toe (31) when the length of the inline skate needs to be changed.

The wheel assembly (40) is mounted on the bottom of the outer heel (32) and is composed of a wheel bracket and multiple wheels (41). The wheel bracket is mounted on the bottom of the outer heel (32). The wheels (41) are mounted in a line in the wheel bracket.

Even though numerous characteristics and advantages of the present invention have been set forth in the foregoing description, together with details of the structure and function of the invention, the disclosure is illustrative only. Changes may be made in detail, especially in matters of shape, size, and arrangement of parts within the principles of the invention to the full extent indicated by the broad general meaning of the terms in which the appended claims are expressed.

What is claimed is:

1. An inline skate with a changeable length comprising:
an inner boot having
an inner toe; and
an inner heel slidably holding the inner toe and having a shank;
an adjusting device comprising
a block attached to the shank of the inner heel and having
a bottom;
a front end;
two sides;
a longitudinal adjustment hole formed in the block and extending to the front end;
a transverse slot defined in the bottom of the block, extending to the two sides and communicating with the longitudinal adjustment hole;
a mounting hole formed vertically through the block adjacent to the transverse slot;
a through hole formed vertically through the block near the front end;
a boot fastener held in the mounting hole; and
a shank fastener mounted through the through hole in the block and the shank to attach the block securely to the inner heel; and
a key mounted through the transverse slot in the block, selectively extending into the longitudinal adjustment hole in the block and having
a flexible shaft mounted through the transverse slot in the block and having
a stationary end;
a moveable end;
a locking segment formed between the ends, mounted through the transverse slot in the block and selectively extending into the longitudinal adjustment hole in the block; and
a mounting coil formed in the flexible shaft near the stationary end; and
a head attached to the moveable end of the flexible shaft and having
an inside surface; and
a lug defined on the inside surface of the head and mounted around the moveable end of the flexible shaft;
an outer boot holding the inner heel, attached to the block and comprising
an outer toe holding the inner toe and having a bottom;
two sides;
a rear edge;
an elongated hole defined longitudinally in the bottom of the outer toe; and
a tongue formed on and protruding from the rear edge of the outer toe, mounted slidably in the longitudinal adjustment hole in the block and having
a bottom surface; and
multiple adjustment slots formed transversely in the bottom of the tongue and selectively aligning with the transverse slot in the block, and the adjustment slot aligned with the transverse slot in the block being engaged by the flexible shaft of the key to hold the outer toe in position; and
an outer heel holding the inner heel, attached to the block and having
a front end;
a rear end;
two sides;
a bottom;
a joint formed at the front end of the outer heel, slidably mounted in the outer toe and having a protrusion formed on the joint and mounted slidably in the elongated hole in the outer toe;
a chamber defined in the rear end of the outer heel to accommodate the tongue and mount the adjusting device and having
a top end; and
an orifice defined in the top end of the chamber to allow the boot fastener to be inserted into the mounting hole in the block of the adjusting device; and
a notch defined in a side of the outer heel, aligned with the chamber and the block of the adjusting device, selectively holding the head of the key and having an elongated through hole defined in the notch to allow the mounting coil to pass through the side of the outer heel so the stationary end of the key can be mounted in the opposite side and to hold and guide the lug; and
a wheel assembly mounted on the bottom of the outer heel and including
a wheel bracket mounted on the bottom of the outer heel; and
multiple wheels are mounted in a line in the wheel bracket.

2. The inline skate with changeable length as claimed in claim 1, wherein
the outer toe further comprises two sliding rails mounted in the bottom of the outer toe respectively near the sides; and
the joint is mounted slidably between the sliding rails in the outer toe.

3. The inline skate with changeable length as claimed in claim 1, wherein the inner boot further includes an insole mounted inside the inner heel and the inner toe.

4. The inline skate with changeable length as claimed in claim 1, wherein
the mounting hole in the block is threaded; and
the boot fastener of the block is a threaded bolt.

* * * * *